US006531429B2

(12) United States Patent
Fletschinger et al.

(10) Patent No.: US 6,531,429 B2
(45) Date of Patent: Mar. 11, 2003

(54) LUBRICANT COMPOSITIONS COMPRISING THIOPHOSPHORIC ACID ESTERS AND DITHIOPHOSPHORIC ACID ESTERS

(75) Inventors: Michael Fletschinger, Bad Krozingen-Biengen (DE); Peter Rohrbach, Liestal (CH); Peter Collen Hamblin, Flüh (CH); Dudley Clark, Breitenbach (CH); Marc Ribeaud, Delémont (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/932,762

(22) Filed: Aug. 17, 2001

(65) Prior Publication Data

US 2002/0016266 A1 Feb. 7, 2002

Related U.S. Application Data

(63) Continuation of application No. 09/146,649, filed on Sep. 3, 1998, now abandoned.

(30) Foreign Application Priority Data

Sep. 18, 1997 (CH) ..... 2202/97

(51) Int. Cl.[7] ..... C10M 137/10

(52) U.S. Cl. ..... 508/433; 508/429; 508/430; 508/437; 508/438; 508/440

(58) Field of Search ..... 508/438, 387, 508/433, 430, 429, 440, 437

(56) References Cited

U.S. PATENT DOCUMENTS

| | | | | |
|---|---|---|---|---|
| 2,250,049 | A | 7/1941 | Moyle | 260/461 |
| 3,254,027 | A | 5/1966 | Matson et al. | 508/408 |
| 3,784,588 | A | 1/1974 | Miles | 260/928 |
| 4,333,841 | A | 6/1982 | Schmidt et al. | |
| 4,431,552 | A | 2/1984 | Salentine | 252/32.7 |
| 4,544,492 | A | 10/1985 | Zinke et al. | |
| 5,362,419 | A | 11/1994 | Zinke et al. | |
| 5,531,911 | A | 7/1996 | Adams et al. | 508/408 |
| 5,747,429 | A | 5/1998 | Katoh et al. | 508/384 |

FOREIGN PATENT DOCUMENTS

| | | |
|---|---|---|
| EP | 368803 | 6/1990 |
| GB | 1043488 | 9/1966 |
| GB | 1506196 | 4/1978 |
| GB | 2178446 | 2/1987 |

*Primary Examiner*—Margaret Medley
(74) *Attorney, Agent, or Firm*—Kevin T. Mansfield

(57) ABSTRACT

The invention relates to improved compositions comprising thiophosphoric acid esters and dithiophosphoric acid esters or phosphoric acid thioesters and oil additives from the group of the polyol partial esters, amines and epoxides, and also to the use of those lubricant compositions in improving the performance properties of lubricants, such as greases, metal-working fluids, gear fluids or hydraulic fluids. Thiophosphoric acid esters and dithiophosphoric acid esters or phosphoric acid thioesters are present in the compositions preferably in a concentration of less than 400 ppm.

14 Claims, No Drawings

LUBRICANT COMPOSITIONS COMPRISING THIOPHOSPHORIC ACID ESTERS AND DITHIOPHOSPHORIC ACID ESTERS

This is a continuation of application Ser. No. 09/146,649, filed on Sep. 3, 1998, now abandoned.

The invention relates to improved compositions comprising thiophosphoric acid esters and dithiophosphoric acid esters or phosphoric acid thioesters, and to the use of those lubricant compositions in improving the performance properties of lubricants, such as greases, metal-working fluids, gear fluids and hydraulic fluids.

Additives added to the said lubricants have to fulfil demanding requirements, such as a high load-carrying capacity, protection against corrosion and wear, and anti-oxidation activity. Zinc dialkyldithiophosphates are suitable for that purpose but, on environmental protection grounds, attempts are being made to replace those compounds by metal-free compounds. The use of metal-free hydraulic fluids is called for especially in agriculture or generally in mobile hydraulic units, where leakages present a risk of contamination of soil or water with zinc compounds. There is therefore a need for metal-free and ashless additives. Suitable hydraulic fluids must also meet the specifications of the leading hydraulic machine manufacturers, for example Denison HFO (Denison Hydraulics) or Vickers M-2980-S (Vickers), and need to be compatible with water. In addition, in accordance with the specifications of DIN 51524 and Denison HFO, they should achieve a failure load stage (FLS) of at least 10 in the FZG test.

Known oil additives for fluids are dithiophosphoric acid esters of the type:

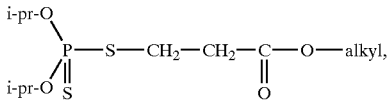

(i-pr = isopropyl)

which are available commercially under the trademark Irgalube® 63 (trademark of Ciba Spezialitätenchemie).

U.S. Pat. Specification No. 5,531,911 describes zinc-free hydraulic fluids that comprise phosphorus- and sulfur-containing additive components. One component is a thiophosphoric acid ester of the triphenylthiophosphate type (IRGALUBE TPPT). This is combined with dithiophosphoric acid esters of the IRGALUBE 63 type and with other optional oil additive components, for example ammonium sulfonates.

A disadvantage of such formulations is their lack of compatibility with water. The contamination of a hydraulic oil with water is a frequent occurrence, especially in the case of mobile hydraulic units. The use of phosphorus- and sulfur-containing additives gives rise to hydrolytic degradation with the formation of corrosive decomposition products that may attack the metals used in the hydraulic units, e.g. steel and copper alloys, and cause damage to hydraulic pumps. In addition, agglomerations of those decomposition products may also block the filters of by-pass filtration units. Since the service life of hydraulic units can be significantly extended by means of very fine filtering, the filter pore sizes of modern by-pass filtration units have been reduced from the earlier 30 $\mu$m to the current 6 $\mu$m. Consequently, only hydraulic oils that form only extremely small amounts of hydrolytic decomposition products when contaminated with water can be used.

The problem underlying the present invention is to prepare compositions that have improved compatibility with water and a significantly lower tendency to form undesired hydrolysis products.

It has surprisingly been found that the addition of a further additive component from the group of the polyol partial esters, amines and epoxides to compositions comprising thiophosphoric acid esters combined with dithiophosphoric acid esters or phosphoric acid thioesters gives compositions that when contaminated with water have a significantly lower tendency to form corrosive hydrolysis products and exhibit very good filtration characteristics. By the addition of further oil additives, e.g. aminephosphates, the load-carrying capacity can be increased and FZG failure load stages≧10 can be achieved.

The invention relates to compositions comprising:

a) a base oil of lubricating viscosity;

b) at least one thiophosphoric acid ester of formula:

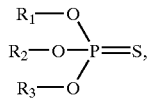

(I)

wherein $R_1$, $R_2$ and $R_3$ are $C_3$–$C_{20}$hydrocarbon radicals;

c) at least one dithiophosphoric acid ester or phosphoric acid thioester of formula:

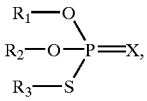

(II)

wherein X is oxygen or sulfur and $R_1$, $R_2$ and $R_3$ are unsubstituted or substituted $C_3$–$C_{20}$hydrocarbon radicals; and d) at least one oil additive from the group of the polyol partial esters, amines and epoxides.

A preferred embodiment concerns compositions comprising:

a) a base oil of lubricating viscosity used for greases, for metal-working fluids, for gear fluids or for hydraulic fluids;

b) at least one thiophosphoric acid ester of formula I wherein $R_1$, $R_2$ and $R_3$ are $C_3$–$C_{20}$hydrocarbon radicals;

c) at least one dithiophosphoric acid ester of formula II wherein X is sulfur and $R_1$, $R_2$ and $R_3$ are unsubstituted $C_3$–$C_{10}$hydrocarbon radicals or wherein $R_1$ and $R_2$ are unsubstituted $C_3$–$C_{10}$hydrocarbon radicals and $R_3$ is a substituted $C_3$–$C_{10}$hydrocarbon radical;

d) at least one oil additive from the group of the polyol partial esters, amines and epoxides;

e) an ammonium phosphate ester of formula:

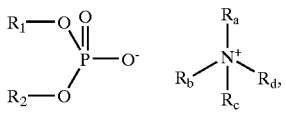

(III)

wherein $R_1$ and $R_2$ are $C_1$–$C_{20}$hydrocarbon radicals and $R_a$, $R_b$, $R_c$ and $R_d$ are each independently of the others hydrogen or a $C_1$–$C_{20}$hydrocarbon radical; and f) at least one customary oil additive.

An especially preferred embodiment concerns compositions in which the phosphorus content of the thiophosphoric acid ester component b) combined with the dithiophosphoric acid ester or phosphoric acid thioester component c), based on the composition comprising components a), b) and c), is less than 400 ppm.

A more especially preferred embodiment concerns compositions in which the phosphorus content of the thiophosphoric acid ester component b) combined with the dithiophosphoric acid ester or phosphoric acid thioester component c) and the ammonium phosphate ester component e), based on the total composition, is less than 400 ppm.

The compositions are especially suitable as multifunctional anti-wear additives—having an additional antioxidative activity—for lubricants, such as greases, metal-working fluids, gear fluids or hydraulic fluids. They are substantially metal-free and ashless and meet the mentioned specifications. Surprisingly, mixtures of components b) and c) in the base oil a) having phosphorus concentrations of less than 400 ppm give very good anti-wear properties, that is to say very good values in the four ball test, and very good friction wear values. With the addition of the additive component from the group of the polyol partial esters, amines and epoxides (component d)), the filtration characteristics of those mixtures when contaminated with water are very good. By adding further oil additives (component e)), failure load stages≧10 can be achieved. Such mixtures meet the hydraulic machines specifications of leading manufacturers, especially Denison HFO.

The terms and definitions used in the context of the description of the present invention preferably have the following meanings:

Component a)

A base oil of lubricating viscosity can be used for the preparation of greases, metal-working fluids, gear fluids and hydraulic fluids. Suitable greases, metal-working fluids, gear fluids and hydraulic fluids are based, for example, on mineral oils or synthetic oils or mixtures thereof. The lubricants will be familiar to the person skilled in the art and are described in the relevant specialist literature, such as, for example, in *Chemistry and Technology of Lubricants;* Mortier, R. M. and Orszulik, S. T. (Editors); 1992 Blackie and Son Ltd. for GB, VCH-Publishers N.Y. for U.S., ISBN 0-216-92921-0, see pages 208 et seq. and 269 et seq.; *in Kirk-Othmer Encyclopedia of Chemical Technology, Fourth Edition* 1969, J. Wiley & Sons, New York, Vol. 13, page 533 et seq. (*Hydraulic Fluids*); *Performance Testing of Hydraulic Fluids*; R. Tourret and E. P. Wright, Hyden & Son Ltd. GB, *on behalf of The Institute of Petroleum London, ISBN* 0 85501 317 6; *Ullmann's Encyclopedia of Ind. Chem., Fifth Completely Revised Edition,* Verlag Chemie, DE-Weinheim, VCH-Publishers for U.S., Vol. A 15, page 423 et seq. (*lubricants*), *Vol.* A 13, page 165 et seq. (*hydraulic fluids*).

The lubricants are especially oils and greases, for example based on mineral oil, or vegetable and animal oils, fats, tallow and wax or mixtures thereof. Vegetable and animal oils, fats, tallow and wax are, for example, palm-kernel oil, palm oil, olive oil, rapeseed oil, rape oil, linseed oil, soybean oil, cottonseed oil, sunflower oil, coconut oil, maize oil, castor oil, low-grade olive oil and mixtures thereof, fish oils, and also the chemically modified, for example epoxidised and sulfoxidised, forms thereof, or forms thereof produced by genetic engineering, for example genetically engineered soybean oil.

Examples of synthetic lubricants include lubricants based on aliphatic or aromatic carboxy esters, polymeric esters, polyalkylene oxides, phosphoric acid esters, polya-olefins or silicones, the diester of a divalent acid with a monohydric alcohol, such as, for example, dioctyl sebacate or dinonyl adipate, a triester of trimethylolpropane with a monovalent acid or with a mixture of such acids, such as, for example, trimethylolpropane tripelargonate, trimethylolpropane tricaprylate or mixtures thereof, a tetraester of pentaerythritol with a monovalent acid or with a mixture of such acids, such as, for example, pentaerythritol tetracaprylate, or a complex ester of monovalent and divalent acids with polyhydric alcohols, for example a complex ester of trimethylolpropane with caprylic and sebacic acid, or a mixture thereof. Apart from mineral oils there are especially suitable, for example, poly-a-olefins, ester-based lubricants, phosphates, glycols, polyglycols and polyalkylene glycols, and also mixtures thereof with water.

An organic or inorganic thickener (base fat) may also be added to the mentioned lubricants or mixtures thereof. Metal-working fluids and hydraulic fluids may be prepared on the basis of the same substances as those described above for the lubricants, such fluids frequently being emulsions of such substances in water or other liquids.

Component b)—thiophosphoric acid esters:

$C_3$–$C_{20}$Hydrocarbon radicals $R_1$, $R_2$ and $R_3$ are preferably $C_3$–$C_{20}$alkyl, $C_5$–$C_{12}$cycloalkyl, $C_5$–$C_{12}$cycloalkyl-$C_1$–$C_4$alkyl, phenyl, $C_7$–$C_{20}$alkylphenyl, $C_7$–$C_{20}$alkoxyphenyl, naphthyl and $C_7$–$C_9$phenylalkyl.

$C_3$–$C_{20}$Alkyl includes branched and unbranched alkyl radicals, for example n-propyl, isopropyl, n-butyl, isobutyl, tert-butyl, n-pentyl, isopentyl, n-hexyl, 2-ethylbutyl, 1-methylpentyl, 1,3-dimethylbutyl, n-heptyl, 3-heptyl, 1-methylhexyl, isoheptyl, n-octyl, 2-ethylhexyl, 1,1,3,3-tetramethylbutyl, 1-methylheptyl, n-nonyl, 1,1,3-trimethylhexyl, n-decyl, n-undecyl, n-dodecyl, 1-methylundecyl, n-tridecyl, n-tetradecyl, n-pentadecyl, n-hexadecyl, n-heptadecyl and n-octadecyl. An especially preferred radical for $R_1$, $R_2$ and $R_3$ is isopropyl. The meanings of $R_1$, $R_2$ and $R_3$ may be the same or different. Thiophosphoric acid esters of formula I are known, for example from U.S. Pat. Specification 5,531,911.

$C_5$–$C_{12}$Cycloalkyl is, e.g., cyclopentyl or cyclohexyl. $C_5$–$C_{12}$Cycloalkyl-$C_1$–$C_4$alkyl is, e.g., cyclopentylmethyl, 2-cyclopentylethyl, cyclohexylmethyl or 2-cyclohexylethyl.

$C_7$–$C_{20}$Alkylphenyl is phenyl that is substituted, for example, by from one to three of the $C_1$–$C_4$alkyl radicals described above or by one or two $C_1$–$C_6$alkyl radicals or one $C_1$–$C_{12}$alkyl radical.

$C_7$–$C_{20}$Alkoxyphenyl is phenyl that is substituted, for example, by from one to three $C_1$–$C_4$-alkoxy radicals, especially methoxy or ethoxy, or by one or two $C_1$–$C_6$alkoxy radicals or one $C_1$–$C_{12}$alkoxy radical, those radicals being analogous to the alkyl radicals mentioned hereinabove $C_7$–$C_9$Phenylalkyl is, e.g., benzyl, 1-phenyl-1-ethyl or 2-phenyl-1-ethyl.

In a preferred embodiment of the invention, component b) consists of a mixture of thiophosphoric acid esters of formula:

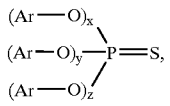

(I')

wherein x is from 0 to 2.7, y is 3–(x+z), z is from 0 to 3–(x+y) and x+y+z=3, and Ar is phenyl, $C_7$–$C_{18}$alkylphenyl, $C_7$–$C_{18}$alkoxyphenyl, naphthyl or $C_7$–$C_9$phenylalkyl as defined above. The preparation of those thiophosphoric acid esters is described in EP-A-368 803. Preferred thiophosphoric acid esters of formula I' are triarylthiophosphate mixtures of the IRGALUBE 211 type comprising substances such as n-decylphenyl-n-nonylphenyl-phenythiophosphate, o-tert-butylphenyl-o-isopropylphenyl-phenylthiophosphate, or n-hexylphenyl-phenylthiophosphate mixtures.

In a further preferred embodiment of the invention, component b) consists of a thiophosphoric acid ester of the triphenylthiophosphate type (IRGALUBE TPPT).

Component c)—dithiophosphoric acid esters or phosphoric acid thioesters:

In compound (II), X is preferably sulfur. Unsubstituted $C_3$–$C_{20}$hydrocarbon radicals $R_1$, $R_2$ and $R_3$ are as defined hereinabove under component b)—thiophosphoric acid esters—and are especially $C_3$–$C_{20}$alkyl.

In a preferred compound (II), $R_1$ and $R_2$ are unsubstituted $C_3$–$C_{10}$hydrocarbon radicals and $R_3$ is a substituted $C_3$–$C_{10}$hydrocarbon radical. Preferably, a substituted $C_3$–$C_{10}$hydrocarbon radical $R_3$ is $C_2$–$C_4$alkyl substituted by carboxy or esterified carboxy, for example of the sub-formula:

(A)

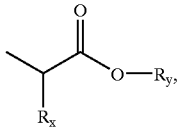

wherein $R_x$ and $R_y$ are hydrogen or $C_1$–$C_4$alkyl, or the corresponding carboxylate salt. Preferred meanings of A are 2-carboxyeth-1-yl and 2-$C_1$–$C_4$alkoxycarbonyleth-1-yl, e.g. methoxycarbonyleth-1-yl or ethoxycarbonyleth-1-yl, or carboxylate salts thereof.

An especially preferred embodiment of the invention uses as component b) a dithiophosphoric acid ester of the IRGALUBE 63 type which has the structural formula given hereinabove, optionally in admixture with a further dithiophosphoric acid ester of formula II wherein $R_1$ and $R_2$ are isopropyl, isobutyl or 2-ethylhexyl and $R_3$ corresponds to the sub-formula A wherein $R_x$ and $R_y$ are hydrogen and is 2-carboxyeth-1-yl.

Dithiophosphoric acid esters and phosphoric acid thioesters are known. Their preparation is described, for example, in U.S. Pat. Specifications 4,333,841, 4,544,492 and 3,784,588 and in British Patent Specification 1,569,730.

In a preferred embodiment of the invention, the phosphorus content of components b) and c), based on the composition comprising components a), b) and c), is less than 400 ppm. In an especially preferred embodiment, the phosphorus content of components b) and c), based on the composition comprising components a), b) and c), is from 150 to 390 ppm, especially from 160 to 370 ppm. The ratio by weight of component b) to component c) may vary within the ranges of approximately from 10:90 to 95:5% by weight.

Component d)—Polyol Partial Esters, Amines and Epoxides

The addition of a further additive component from the group of the polyol partial esters, amines and epoxides yields compositions that have an improved compatibility with water on contamination. Suitable oil additives are polyol partial esters, for example from the group of the mono- and di-glycerides, monoacetylated and diacetylated monoglycerides, polyglycerol fatty acid esters, sorbitan fatty acid esters and partial fatty acid esters of polyoxyethylene sorbitan. Those oil additives are added in a concentration of approximately from 0.01 to 2.0%.

Suitable mono- and di-glycerides are derived from glycerol by the esterification of one or two hydroxy groups with one or two acid radicals of saturated or unsaturated carboxylic acids having an even number of from 8 to 20 carbon atoms.

The acid radical of a saturated carboxylic acid having an even number of from 8 to 20 carbon atoms that esterifies the polyglycerol base structure is preferably straight-chain and has 12, 14, 16 or 18 carbon atoms, for example n-dodecanoyl, n-tetradecanoyl, n-hexadecanoyl or n-octadecanoyl.

The acid radical of an unsaturated carboxylic acid having an even number of from 8 to 20 carbon atoms that esterifies the glycerol base structure is preferably straight-chain and has 12, 14, 16 or 18 carbon atoms and one double bond, for example, 9-cis-dodecenoyl, 9-cis-tetradecenoyl, 9-cis-hexadecenoyl or 9-cis-octadecenoyl.

The following names are also customary for the mentioned acid radicals: 9-cis-dodecenoyl (lauroleoyl), 9-cis-tetradecenoyl (myristoleoyl), 9-cis-hexadecenoyl (palmitoleoyl), 6-cis-octadecenoyl (petroseloyl), 6-trans-octadecenoyl (petroselaidoyl), 9-cis-octadecenoyl (oleoyl), 9-trans-octadecenoyl (elaidoyl), 11-cis-octadecenoyl (vaccenoyl), 9-cis-icosenoyl (gadoleoyl), n-dodecanoyl (lauroyl), n-tetradecanoyl (myristoyl), n-hexadecanoyl (palmitoyl), n-octadecanoyl (stearoyl), n-icosanoyl (arachidoyl).

Especially suitable mono- and di-glycerides are available commercially under the names Loxiol® G 10 and G 16 (Henkel), Nutrisofte® 100 (Grünau), Kessco GMO (Akzo) and Edenor® GMO, GDO (Henkel).

A suitable monoacetylated or diacetylated monoglyceride is a monoglyceride that has, in addition to the acyl radical of a fatty acid, preferably one or two acetyl radicals. The acyl radical is derived preferably from one of the mentioned unsaturated fatty acids having an even number of more than ten carbon atoms. A monoglyceride obtainable from a mixture of monoacetylated or diacetylated monoglycerides using customary methods of separation, e.g. fractional distillation, is preferred.

Acetylated monoglycerides commercially obtainable under the trademark MYVACET (Eastman) are especially preferred. Acetylated monoglycerides of the MYVACET series are used industrially as lubricants, plasticisers, non-ionic emulsifiers and solubilisers. Especially preferred are the products obtainable commercially under the name MYVACET 5-07, 7-00, 7-07, 9-08, 9-40 and 9-45 K.

A suitable polyglycerol fatty acid ester consists of a substantially pure polyglycerol fatty acid ester or a mixture of different polyglycerol fatty acid esters in which the polyglycerol base structure contains preferably up to and including 10 glycerol units that are esterified by from 1 to 10 acid radicals of the mentioned saturated or unsaturated carboxylic acids having an even number of from 8 to 20 carbon atoms.

Suitable polyglycerol fatty acid esters having a uniformly defined structure are, for example, diglycerol monocaprate, diglyceryl monolaurate, diglycerol diisostearate, diglycerol monoisostearate, diglycerol tetrastearate (polyglyceryl 2-tetrastearate), triglycerol monooleate (polyglyceryl 3-monooleate), triglycerol monolaurate, triglycerol monostearate (polyglyceryl 3-stearate), triglycerol monoisostearate, hexaglycerol dioleate (polyglycerol 6-dioleate), hexaglycerol distearate (polyglycerol 6-distearate), decaglycerol dioleate (polyglycerol 10-dioleate), decaglycerol tetraoleate (polyglycerol 10-tetraoleate), decaglycerol decaoleate (polyglycerol 10-decaoleate), decaglycerol decastearate (polyglycerol 10-decastearate). The CTFA nomenclature is given in brackets. Those products are available commercially under the trademark Caprol® (trademark of Karlshamns USA Inc., Columbus Ohio). Specific product names: CAPROL 2G4S, 3GO, 3GS, 6G2O, 6G2S, 10G2O, 10G4O, 10G10O, 10G10S. Further products are available under the names DGLC-MC, DGLC-ML, DGLC-DISOS, DGLC-MISOS, TGLC-ML and TGLC-MISOS from Solvay Alkali GmbH, D-3002 Hanover.

Mixtures of different polyglycerol fatty acid esters are defined by names such as decaglycerol mono- and di-oleate, polyglycerol ester of mixed fatty acids, polyglycerol esters of fatty acids, and polyglycerol caprate, cocoate, laurate, lanolinate, isostearate and ricinolate and are available commercially under the trademarks Triodan® and Homodan® (trademark of Grindsted Products, Grindsted Denmark), specific product names: TRIODAN 20, 55, R90 and HOMODAN MO, Radiamuls® (trademark of Petrofina (FINA), Brussels, Belgium), specific product name RADIAMULS poly 2253, and the name CAPROL PGE860 or ET, or the trademark Plurol® (trademark of Gattefossé Etablissements, Saint-Priest, France), specific product name PLUROL Stearique WL1009 or PLUROL Oleique WL1173. Further products are available under the names PGLC-C1010S, PGLC-C0810, PGLC-C1010/S, PGLC-LT2010, PGLC-LAN0510/S, PGLC-CT2010/90, PGLC-ISOSTUE, PGLC-RUE and PGLC-ISOS0410 from Solvay Alkali GmbH, D-3002 Hanover.

A suitable sorbitan fatty acid ester consists preferably of a substantially pure sorbitan fatty acid ester or a mixture of different sorbitan fatty acid esters in which the sorbitan base structure is esterified by from 1 to 3 acid radicals of one of the mentioned saturated or unsaturated straight-chain carboxylic acids having an even number of from 8 to 20 carbon atoms.

Suitable sorbitan fatty acid esters are especially sorbitan monolaurate, monopalmitate, monostearate, tristearate, monooleate, sesquioleate and trioleate. Those products are available commercially under the trademarks Span® (trademark of Atlas, Wilmington USA), specific product names: SPAN 20, 40, 60, 65, 80 and 85, Arlacel® (trademark of Atlas), specific product names: ARLACEL 20, 40, 60, 80, 83, 85 and C, Crill® (trademark of Croda Chemicals Ltd., Cowick Hall, Snaith Goole GB), specific product names: CRILL 1, 3 and 4, Dehymuls® (trademark of Henkel, Düsseldorf DE), specific product names: DEHYMULS SML, SMO, SMS, SSO, Famodan® (trademark of Grindsted Products, Grindsted Denmark), specific product names: FAMODAN MS and TS, Capmul® (trademark of Karlshamns USA Inc., Columbus, Ohio), specific product names: CAPMUL S and O, and Radiasurf® (trademark of Petrofina (FINA), Brussels, Belgium), specific product names: RADIASURF 7125, 7135, 7145 and 7155.

The mentioned partial fatty acid ester of polyoxyethylene sorbitan consists preferably of a substantially pure ester of sorbitan or a mixture of different esters of sorbitan in which the structure of the fatty acid groups and the length of the polyoxyethylene chains vary. The sorbitan is preferably etherified by three polyoxyethylene chains and esterified by one fatty acid group. Alternatively, however, the sorbitan may be etherified by only one or two polyoxyethylene chains and accordingly esterified by two or three fatty acid groups. Altogether, the sorbitan base structure is substituted by a minimum of two and a maximum of four hydrophilic groups, the polyoxyethylene chains and the fatty acid groups being covered by the term "hydrophilic groups".

The polyoxyethylene chain is straight-chain and has preferably from 4 to 10, especially from 4 to 8, ethylene oxide units. The ester groups on the sorbitan base structure are derived from a saturated or unsaturated, straight-chain carboxylic acid having an even number of from 8 to 20 carbon atoms. The ester group derived from that carboxylic acid is preferably straight-chain and has 12, 14, 16 or 18 carbon atoms, e.g. n-dodecanoyl, n-tetradecanoyl, n-hexadecanoyl or n-octadecanoyl. The ester group derived from an unsaturated carboxylic acid having an even number of from 8 to 20 carbon atoms is preferably straight-chain and has 12, 14, 16 or 18 carbon atoms, e.g. oleoyl.

Suitable partial fatty acid esters of polyoxyethylene sorbitan are available commercially under the trademark Tween® of ICI and are known by the chemical names polyoxyethylene(20 or 4)-sorbitan monolaurate (TWEEN 20 and 21), polyoxyethylene-(20)-sorbitan monopalmitate or monostearate (TWEEN 40 and 60), polyoxyethylene-(4 or 20)-sorbitan monostearate or tristearate (TWEEN 61 and 65), polyoxyethylene-(20 or 5)-sorbitan monooleate (TWEEN 80 or 81) and polyoxyethylene-(20)-sorbitan trioleate (TWEEN 85).

Suitable amines are, for example, primary or secondary amines having the $C_1$–$C_{20}$alkyl radicals described hereinabove, especially $C_2$–$C_{20}$alkyl, which may, for example, be substituted by hydroxy (alkanolamines) or interrupted by oxygen (ether amines), polyoxyalkylene diamines or polyoxyalkylene polyamines, and also primary or secondary amines having $C_5$–$C_6$cycloalkyl radicals, e.g. cyclopentyl or cyclohexyl radicals.

Suitable alkanolamines are, for example, ethanolamine, isopropanolamine, 2-amino-2-methyl-1-propanol, 2-(2-aminoethoxy)-ethanol, 3-amino-1-propanol, 2-amino-1-butanol, 2-amino-2-methyl-1,3-propanediol and 2-amino-2-ethyl-1,3-propanediol.

Suitable alkanolamines are available commercially, for example, under the trademarks ETHOMEEN and PROPOMEEN (Armak Chemical Div. of Akzona, Inc., Chicago USA), for example the products ETHOMEEN C/15, C/20, C/25, O/12, S/15, S/20, T/12, T/15 and T/25 and the corresponding products of the PROPOMEEN series.

Suitable ether amines are primary ether amines, which are available commercially under the trademark SURFAM (Mars Chemical Co., Atlanta USA), for example the products SURFAM P14B (decyloxypropylamine) or P16A or P17B (tridecyloxypropylamine).

Suitable polyoxyalkylenediamines are, for example, alkoxylated diamines of the Ethoduomeen® type (Armak), for example the products T/13 and T/20. Suitable polyoxyalkylene polyamines are available commercially, for example, under the trademark JEFFAMINE (Jefferson Chemical Co.), for example the products D-230, D-400, D-1000, D-2000 and T-403.

Suitable epoxides are, for example, $C_4$–$C_{20}$epoxyalkanes, e.g. epoxybutane, or esters of $C_{10}$–$C_{20}$fatty acids, especially esters of epoxidised fatty acids with monohydric alcohols or polyhydric alcohols, e.g. glycerides. Preferred are epoxidised esters of fatty acids with monohydric alcohols, for example straight-chain and branched $C_1$–$C_{10}$alkyl, $C_1$–$C_{10}$alkoxy, aryl or $C_5$–$C_8$cycloalkyl esters of $C_{10}$–$C_{20}$fatty acids, e.g. cyclopentyl, cyclohexyl, n-butyl, n-hexyl, benzyl, methoxyethyl, n-octyl, phenyl or tert-butylphenyl epoxystearate or epoxyoleate, and also epoxidised soybean oil or linseed oil or epoxidised natural oils and fats that are known to have a high content of unsaturated fatty acids.

Component e)—Ammonium Phosphate:

In an ammonium phosphate ester of formula III, $R_1$ and $R_2$ are $C_1$–$C_{20}$hydrocarbon radicals and $R_a$, $R_b$, $R_c$ and $R_d$ are each independently of the others hydrogen or a $C_1$–$C_{20}$hydrocarbon radical. $R_1$ and $R_2$ and also $R_a$, $R_b$, $R_c$ and $R_d$ as $C_1$–$C_{20}$hydrocarbon radicals are preferably $C_1$–$C_7$alkyl, e.g. methyl, ethyl, n-propyl, isopropyl, n-butyl, isobutyl, tert-butyl, n-pentyl, isopentyl, n-hexyl, 2-ethylbutyl, 1-methylpentyl, 1,3-dimethylbutyl or n-heptyl.

The aminephosphate is added in a low concentration of approximately from 200 to 500 ppm. As a result of that addition, the hydraulic oil acquires an especially good load-carrying capacity (FZG failure load stages≧10). In the preferred embodiment the total content of phosphorus in components b), c) and e), based on the total composition, is less than 400 ppm.

Component f)—Further Oil Additives:

The mentioned lubricant compositions, e.g. greases, gear fluids, metal-working fluids and hydraulic fluids, may additionally comprise further additives that are added in order to improve their basic properties still further. Such additives include: further antioxidants, metal passivators, rust inhibitors, viscosity index enhancers, pour-point depressants, dispersants, detergents, further extreme-pressure additives and anti-wear additives. Such additives are added in the amounts customary for each of them, which range in each case approximately from 0.01 to 10.0% by weight. Examples of further additives are given below:

Examples of phenolic antioxidants:

1.1. Alkylated monophenols, e.g. 2,6-di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols branched in the side chain, such as, for example, 2,6-dinonyl-4-methylphenol, 2,4-dimethyl-6-(1'-methylundec-1'-yl)-phenol, 2,4-dimethyl-6-(1'-methylheptadec-1'-yl)-phenol, 2,4-dimethyl-6-(1'-methyltridec-1'-yl)-phenol and mixtures thereof.

1.2. Alkylthiomethylphenols, e.g. 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol.

1.3. Hydroquinones and alkylated hydrocuinones, e.g. 2,6-di-tert-butyl-4-methoxyphenol, 2,5-di-tert-butylhydroquinone, 2,5-di-tert-amylhydroquinone, 2,6-diphenyl-4-octadecyl-oxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis(3,5-di-tert-butyl-4-hydroxyphenyl)adipate.

1.4. Tocopherols, e.g. α-, β-, γ- or δ-tocopherol and mixtures thereof (vitamin E).

1.5. Hydroxylated thiodiphenyl ethers, e.g. 2,2'-thio-bis(6-tert-butyl-4-methylphenol), 2,2'-thio-bis(4-octylphenol), 4,4'-thio-bis(6-tert-butyl-3-methylphenol), 4,4'-thio-bis (6-tert-butyl-2-methylphenol), 4,4'-thio-bis(3,6-di-sec-amylphenol), 4,4'-bis(2,6-dimethyl-4-hydroxyphenyl) disulfide.

1.6. Alkylidene bisphenols, e.g. 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylhenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)butyrate], bis(3-tert-butyl-4-hydroxy-5-methylphenyl)dicyclopentadiene, bis[2-(3'-tert-butyl-2'-hydroxy-5'-methylbenzyl)-6-tert-butyl-4-methytphenyl]terephthalate, 1,1-bis(3,5-dimethyl-2-hydroxyphenyl)butane, 2,2-bis(3,5-di-tert-butyl-4-hydroxyphenyl)propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane.

1.7. O-, N- and S-benzyl compounds, e.g. 3,5,3',5'-tetra-tert-butyl-4,4'-dihydroxydibenzyl ether, octadecyl-4-hydroxy-3,5-dimethylbenzyl-mercaptoacetate, tridecyl-4-hydroxy-3,5-di-tert-butylbenzyl-mercaptoacetate, tris(3,5-di-tert-butyl-4-hydroxybenzyl)amine, bis(4-tert-butyl-3-hydroxy-2,6-dimethylbenzyl)dithioterephthalate, bis(3,5-di-tert-butyl-4-hydroxybenzyl)sulfide, isooctyl-3,5-di-tert-butyl-4-hydroxybenzyl-mercaptoacetate.

1.8. Hydroxybenzylated malonates, e.g. dioctadecyl-2,2-bis (3,5-di-tert-butyl-2-hydroxybenzyl)malonate, dioctadecyl-2-(3-tert-butyl-4-hydroxy-5-methylbenzyl) malonate, didodecylmercaptoethyl-2,2-bis(3,5-di-tert-butyl-4-hydroxybenzyl)malonate, di[4-(1,1,3,3-tetramethylbutyl)-phenyl]-2,2-bis(3,5-di-tert-butyl-4-hydroxybenzyl)malonate.

1.9. Hydroxybenzyl aromatic compounds, e.g. 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol.

1.10. Triazine compounds, e.g. 2,4-bis-octylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis (3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl) isocyanurate, 1,3,5-tris(4-tert-butyl-3-hydroxy-2,6-dimethylbenzyl)isocyanurate, 2,4,6-tris(3,5di-tert-butyl-4-hydroxyphenylethyl)-1,3,5-triazine, 1,3,5-tris(3,5-di-tert-butyl-4-hydroxyphenyl-propionyl)hexahydro-1,3,5-triazine, 1,3,5-tris(3,5-dicyclohexyl-4-hydroxybenzyl) isocyanurate.

1.11. Acylaminophenols, e.g. 4-hydroxylauric acid anilide, 4-hydroxystearic acid anilide, N-(3,5-di-tert-butyl-4-hydroxyphenyl)-carbamic acid octyl ester.

1.12. Esters of β-(3.5-di-tert-butyl-4-hydroxyphenyl) propionic acid with mono- or poly-hydric alcohols, e.g. with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.13. Esters of β-(5-tert-butyl-4-hydroxy-3-methylphenyl) propionic acid with mono- or poly-hydric alcohols, e.g. with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis-(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.14. Esters of β-(3.5-dicyclohexyl-4-hydroxyphenyl) propionic acid with mono- or poly-hydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis(hydroxyethylpxalic acid diamide, 3-thiaundecanol, 3-thiapentadecanol, trimethylhexanediol, trimethylolpropane, 4-hydroxymethyl-1-phospha-2,6,7-trioxabicyclo[2.2.2] octane.

1.15. Esters of 3.5-di-tert-butyl-4-hydroxyphenylacetic acid with mono- or poly-hydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2] octane.

1.16. Amides of β-(3.5-di-tert-butyl-4-hydroxyphenyl) propionic acid, e.g. N,N'-bis(3,5-di-tert-butyl-4-hydroxyphenylpropionyl)hexamethylenediamine, N,N'-bis(3,5-di-tert-butyl-4-hydroxyphenylpropionyl) trimethylenediamine, N,N'-bis(3,5-di-tert-butyl-4-hydroxyphenylprcpionyl)-hydrazine.

1.17. Ascorbic acid (vitamin C).

1.18. Aminic antioxidants, e.g. N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-di(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-(4-tert-octylphenyl)-1-naphthylamine, N-phenyl-2-naphthylamine, octylated diphenylamine, e.g. p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di(4-methoxyphenyl)amine, 2,6-di-tert-butyl-4-dimethylaminomethyl phenol, 2,4'-diaminodiphenylmethane, 4,4'-diaminodiphenylmethane, N,N,N',N'-tetramethyl-4,4'-diaminodiphenylmethane, 1,2-di[(2-methylphenyl)amino]ethane, 1,2-di (phenylamino)propane, (o-tolyl)biguanide, di[4-(1',3'-dimethylbutyl)phenyl]amine, tert-octylated N-phenyl-1-naphthylamine, mixture of mono- and di-alkylated tert-buty/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyidiphenylamines, 2,3-dihydro-3,3-dimethyl-4H-1,4-benzothiazine, phenothiazine, mixture of mono- and di-alkylated tert-butyl/tert-octyl-phenothiazines, mixture of mono- and di-alkylated tert-octylphenothiazines, N-allyiphenothiazine, N,N,N',N'-tetraphenyl-1,4-diaminobut-2-ene, N,N-bis(2,2,6,6-tetramethylpiperidin-4-yl)hexamethylenediamine, bis(2,2,6,6-tetramethylpiperidin-4-yl)sebacate, 2,2,6,6-tetramethylpiperidin-4-one, 2,2,6,6-tetramethylpiperidin-4-ol.

Examples of further antioxidants:

Aliphatic or aromatic phosphites, esters of thiodipropionic acid or thiodiacetic acid or salts of dithiocarbamic or dithiophosphoric acid, 2,2,12,12-tetramethyl-5,9-dihydroxy-3,7,11-trithiatridecane and 2,2,15,15-tetramethyl-5,12-dihydroxy-3,7,10,14-tetrathiahexadecane.

Examples of metal deactivators, e.g. for copper:

a) Benzotriazoles and derivatives thereof, e.g. 2-mercaptobenzotriazole, 2,5-dimercaptobenzotriazole, 4- or 5-alkylbenzotriazoles (e.g. tolutriazole) and derivatives thereof, 4,5,6,7-tetrahydrobenzotriazole, 5,5'-methylenebis-benzotriazole; Mannich bases of benzotriazole or tolutriazole, such as 1-[di(2-ethylhexyl) aminomethyl]tolutriazole and 1-[di(2-ethylhexyl) aminomethyl]benzotriazole; alkoxyalkylbenzotriazoles, such as 1-(nonyloxymethyl)-benzdtriazole, 1-(1-butoxyethyl)-benzotriazole and 1-(1-cyclohexybxybutyl)-tolutriazole.

b) 1,2,4-Triazoles and derivatives thereof, e.g. 3-alkyl-(or -aryl-)1,2,4-triazoles, Mannich bases of 1,2,4-triazoles, such as 1-[di(2-ethylhexyl)aminomethyl]-1,2,4-triazole; alkoxyalkyl-1,2,4-triazoles, such as 1-(1-butoxyethyl)-1,2,4-triazole; acylated 3-amino-1,2,4-triazoles.

c) Imidazole derivatives, e.g. 4,4'-methylenebis(2-undecyl-5-methyl)imidazole and bis[(N-methyl)imidazol-2-yl] carbinol-octyl ether.

d) Sulfur-containing heterocyclic compounds, e.g. 2-mercaptobenzothiazole, 2,5-dimercapto-1,3,4-thiadiazole, 2,5-dimercaptobenzothiadiazole and derivatives thereof; 3,5-bis[di(2-ethylhexyl)aminomethyl]-1,3,4-thiadiazolin-2-one.

e) Amino compounds, e.g. salicylidene-propylenediamine, salicylaminoguanidine and salts thereof.

Examples of rust inhibitors:

a) Organic acids, their esters, metal salts, amine salts and anhydrides, e.g. alkyl- and alkenyl-succinic acids and their partial esters with alcohols, diols or hydroxycarboxylic acids, partial amides of alkyl- and alkenyl-succinic acids, 4-nonylphenoxyacetic acid, alkoxy- and alkoxyethoxy-carboxylic acids, such as dodecyloxyacetic acid, dodecyloxy(ethoxy)acetic acid and amine salts thereof, and also N-oleoyl-sarcosine, sorbitan monooleate, lead naphthenate, alkenylsuccinic acid anhydrides, e.g. dodecenylsuccinic acid anhydride, 2-(2-carboxyethyl)-1-dodecyl-3-methylglycerol and salts thereof, especially sodium and triethanolamine salts thereof.

b) Nitrogen-containing compounds, e.g.:

i. Tertiary aliphatic or cycloaliphatic amines and amine salts of organic and inorganic acids, e.g. oil-soluble alkylammonium carboxylates, and 1-[N,N-bis(2-hydroxyethyl)amino]-3-(4-nonylphenoxy)propan-2-ol.

ii. Heterocyclic compounds, e.g.: substituted imidazolines and oxazolines, e.g. 2-heptadecenyl-1-(2-hydroxyethyl)4midazoline.

c) Sulfur-containing compounds, e.g.: barium dinonylnaphthalene sulfonates, calcium petroleum sulfonates, alkylthio-substituted aliphatic carboxylic acids, esters of aliphatic 2-sulfocarboxylic acids and salts thereof.

Examples of viscosity index enhancers: polyacrylates, polymethacrylates, vinylpyrrolidone/-methacrylate copolymers, polyvinylpyrrolidones, polybutenes, olefin copolymers, styrene/-acrylate copolymers, polyethers.

Examples of pour-point depressants: poly(meth)acrylates, ethylene/vinyl acetate copolymers, alkylpolystyrenes, fumarate copolymers, alkylated naphthalene derivatives.

Examples of dispersants/surfactants: polybutenylsuccinic acid amides or imides, polybutenyl-phosphonic acid derivatives, basic magnesium, calcium and barium sulfonates and phenolates.

Examples of extreme-pressure and anti-wear additives:

Sulfur- and halogen-containing compounds, e.g. chlorinated paraffins, sulfurated olefins or vegetable oils (soybean oil, rape oil), alkyl- or aryl-di- or -tri-sulfides, benzotriazoles or derivatives thereof, such as bis(2-ethylhexyl) aminomethyl tolutriazoles, dithiocarbamates, such as methylene-bis-dibutyldithiocarbamate, derivatives of 2-mercaptobenzothiazole, such as 1-[N,N-bis(2-ethylhexyl) aminomethyl]-2-mercapto-1H-1,3-benzothiazole, derivatives of 2,5-dimercapto-1,3,4-thiadiazole, such as 2,5-bis (tert-nonyldithio)-1,3,4-thiadiazole.

Examples of coefficient of friction reducers, e.g. lard oil, oleic acid, tallow, rape oil, sulfurated fats, amines. Further examples are given in EP 565 487.

Examples of special additives for use in water/oil metal-working fluids and hydraulic fluids:

Emulsifiers: petroleum sulfonates, amines, such as polyoxyethylated fatty amines, non-ionic surface-active substances; buffers: alkanolamines; biocides: triazines, thiazolinones, tris-nitromethane, morpholine, sodium pyridenethiol; processing seed improvers: calcium and barium sulfonates;

The above-mentioned components may be admixed with the lubricants in a manner known per se. It is also possible to prepare a concentrate or a so-called "additive pack", which can be diluted to give the working concentrations for the lubricant in question, as appropriate to the intended use.

A preferred embodiment of the invention concerns a composition comprising a) a base oil of lubricating viscosity used for greases, for metal-working fluids, for gear fluids or for hydraulic fluids;

b) at least one thiophosphoric acid ester from the group of the thiophosphoric acid esters of formula I wherein $R_1$, $R_2$ and $R_3$ are phenyl, or mixtures of thiophosphoric acid esters of formula I' wherein x is from 0 to 2.7, y is 3–(x+z), z is from 0 to 3–(x+y) and x+y+z=3, and Ar is phenyl or $C_7C_{18}$alkylphenyl;

c) at least one dithiophosphoric acid ester of formula II wherein X is sulfur, $R_1$ and $R_2$ are $C_3$–$C_{10}$alkyl and $R_3$ is 2-carboxyeth-1-yl or 2-$C_1$–$C_4$alkoxycarbonyleth-1-yl, or a salt thereof;

d) at least one oil additive from the group of the polyol partial esters, amines and epoxides, wherein the phosphorus content of the thiophosphoric acid ester component b) combined with the dithiophosphoric acid ester or phosphoric acid thioester component c), based on the composition comprising components a), b) and c), is less than 400 ppm.

A further especially preferred embodiment of the invention concerns a composition comprising a) a base oil of lubricating viscosity used for greases, for metal-working fluids, for gear fluids or for hydraulic fluids;

b) at least one thiophosphoric acid ester from the group of thiophosphoric acid esters of formula I wherein $R_1$, $R_2$ and $R_3$ are phenyl, or mixtures of thiophosphoric acid esters of formula I' wherein x is from 0 to 2.7, y is 3–(x+z), z is from 0 to 3–(x+y) and x+y+z=3, and Ar is phenyl or $C_7$–$C_{18}$alkylphenyl;

c) at least one dithiophosphoric acid ester of formula II wherein X is sulfur, $R_1$ and $R_2$ are $C_3$–$C_{10}$alkyl and $R_3$ is 2-carboxyeth-1-yl or 2-$C_1$–$C_4$alkoxycarbonyleth-1-yl, or a salt thereof, d) at least one oil additive from the group of the polyol partial esters, amine and epoxides; and e) at least one ammonium phosphate ester of formula III wherein $R_1$ and $R_2$ are $C_1$–$C_{20}$alkyl, one of the radicals $R_a$, $R_b$, $R_c$ and $R_d$ is hydrogen and the other radicals are $C_1$–$C_{20}$alkyl; and f) at least one customary oil additive, wherein the phosphorus content of components b), c) and e), based on the total composition, is less than 400 ppm.

The present invention relates also to a concentrate that can be used in the preparation of a composition comprising b) at least one thiophosphoric acid ester of formula:

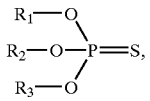

(I)

wherein $R_1$, $R_2$ and $R_3$ are $C_3$–$C_{20}$hydrocarbon radicals; and c) at least one dithiophosphoric acid ester or phosphoric acid thioester of formula:

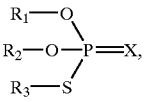

(II)

wherein X is oxygen or sulfur and $R_1$, $R_2$ and $R_3$ are unsubstituted or substituted $C_3$–$C_{20}$–hydrocarbon radicals; and d) at least one oil additive from the group of the polyol partial esters, amines and epoxides.

The concentrate may comprise the following additional constituents:

e) an ammonium phosphate ester of formula:

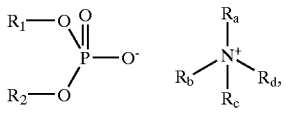

(III)

wherein $R_1$ and $R_2$ are $C_1$–$C_{20}$hydrocarbon radicals and $R_a$, $R_b$, $R_c$ and $R_d$ are each independently of the others hydrogen or $C_1$–$C_{20}$hydrocarbon radicals; and f) at least one customary oil additive.

The components are so combined in the concentrate that the concentrate is fluid at room temperature without the addition of the base oil a) or a solvent.

The invention relates also to a method of improving the performance properties of lubricants, which comprises adding components b), c) and d), preferably in such a concentration that the phosphorus content of those components, based on the total composition, is less than 400 ppm.

The invention relates also to the use of compounds of components b) c) and d), preferably in the mentioned concentration, as additives in motor oils, turbine oils, gear oils, hydraulic fluids, metal-working fluids or lubricating greases.

The following Examples illustrate the invention:

EXAMPLES 1–15

Reference Examples (prior art I and II)

The various mixtures were prepared using an ISO VG 46 mineral oil (kinematic viscosity at 40° C.: 42–50 CSt) and a base/additive mixture typically used for hydraulic fluids. The base/additive mixture is free of metal salts and is used at the range of 0.29 to 0.47% (% by weight). It is a combination of an aromatic amine antioxidant (e.g. Irganox® L 57), a hindered phenol antioxidant (e.g. Irganox® L 135) and comparatively small amounts of other customary additives, such as pour-point depressants (e.g. Plexol® 154), antifoams (e.g. Mobilad® $C_{402}$), de-emulsification additives (e.g. Synperonic® PEL81), corrosion inhibitors (e.g. Irgacor® NPA) and metal deactivators (e.g. lrgamet® 39). The additives and mixtures used and the results of the tests carried out are listed in the Table. Formulations 9, 10, 11, 12, 13 and 14 correspond to the claimed composition of the present invention. The other formulations are used for the purpose of a comparison, especially with the prior art compositions.

The following tests were carried out: examination of anti-wear properties: four ball test and friction wear test, compatibility with water (storage of the oil with water under specific conditions, followed by filtration and a rust test), load-carrying capacity (extreme pressure): FZG.

1. Four ball tester (from Shell according to DIN 51530, IP 239)—determination of the wear characteristics (wear scar diameter, abbreviation WSD) of liquid lubricants according to DIN 51350 T3; revs/min: 1420, load: 40 kg (400 N), duration: 1 hour (h); good values: <0.45 mm
2. Friction wear apparatus (from Optimol Instruments, Munich, Germany) according to DIN 51834 (in yellow print); measurement of the wear on the plate; principle: a steel ball acted on by a vertical force $F_N$ executes an oscillating sliding movement against a fixed steel cylinder; system: balvplate; load: 300 N, duration: 2 h, temperature: 100° C., frequency: 50 Hz (deviating from DIN 51834 T2, a temperature of 100° C. was used instead of 50° C. since, for the Denison Hydraulics specification mentioned at the beginning (HFO), a temperature of 100° C. is required for the necessary P 46 piston pump test). The wear on the plate was measured. In that procedure, using a Talysurf device the surface of the plate having the spherical wear indentation was scanned and the greatest depth was measured. The distance between the deepest point and the surface of the plate is quoted in $\mu$m profile depth to indicate the wear characteristic. The wear values quoted are relative wear values. High values (>3 $\mu$m) indicate a high degree of wear.
3. The compatibility-with-water test is used to examine the effect of water on two important properties of a hydraulic oil: filterability and protection against rust. 1.5 l of the fluid to be tested are first of all aged for 10 days at 100° C. together with 1% water (closed vessel), the vessel being shaken vigorously for 1 minute every day. After 10 days, 3×300 ml of the aged fluid are filtered through a 0.8 $\mu$m filter under pressure (1 bar) in accordance with the conditions of the AFNOR standard filtration test E48-691 or E-48 690. The result of this test is quoted as the filtration index FI and represents the average of three individual measurements. $FI=T_{300}-T_{200}/2(T_{100}-T_{50})$; $T_{300}$=time, in seconds, required for 300 ml to pass through the filter; $T_{200}$= time, in seconds, required for 200 ml to pass through the filter, and so on. Values<2 are classified as being a "pass", values>2 as a "fail" (according to the specification: Denison HF 0). The remaining 600 ml of the aged fluid contaminated with 1% water are subjected to a rust test (double test using 300 ml for each test) according to ASTM standard D 665 B. In that test a steel bolt ground until rust-free is maintained at 60° for 24 h in a mixture of 300 ml of test oil (already contaminated with 1% distilled water) and 30 ml of sea water, which is vigorously circulated with a stirrer. After removal of the steel bolt the degree of corrosion is assessed visually. Rating 0=no corrosion, rating 3=serious corrosion.
4. FZG gear test (description in DIN 51.354, AN8.3/90, IP 334179). In the splash lubrication method, defined gears rotate at a constant speed and fixed initial temperature in the fluid to be tested. The loading of the gears is increased in stages. From load stage 4, the change in the tooth profiles is recorded after each stage by describing and, where appropriate, by photographing, by measuring the roughness, or by contact impression. The limit load stage is one stage below the so-called failure load stage (abbreviation: FLS) at which at least two profiles of the test gear exhibit clear damage (fissures or similar).

TABLE

| | 1 | 2 | 3 | 4 | 5 | 6 | 7 | 8 | 9 | 10 | 11 | 12 | 13 | 14 | 15 | Prior art I | Prior art II |
|---|---|---|---|---|---|---|---|---|---|---|---|---|---|---|---|---|---|
| component b)$_1$[1] | | 0.50 | 0.35 | | | | | | | | | 0.10 | 0.10 | | | 0.25 | 0.25 |
| component b)$_2$[2] | | | | 0.58 | 0.37 | | | | 0.15 | 0.15 | 0.15 | | | 0.15 | 0.050 | | |
| component c)$_1$[3] | | | | | | 0.225 | 0.36 | | 0.25 | 0.225 | 0.225 | 0.27 | 0.27 | 0.23 | 0.12 | 0.30 | 0.30 |
| component c)$_2$[4] | | | | | | | | 0.4 | | | | | | | | | |
| component d)$_1$[5] | | | | | | | | | | 0.025 | 0.025 | 0.03 | 0.03 | 0.025 | 0.013 | | |
| component d)$_2$[6] | | | | | | | | | | | 0.08 | 0.08 | | 0.08 | 0.04 | | |
| component d)$_3$[7] | | | | | | | | | | | | | 0.025 | | | | |
| component e)[8] | | | | | | | | | | | | 0.03 | 0.03 | 0.03 | 0.035 | | |
| ammonium sulfonate[9] (Nasul ®TA) | | | | | | | | | | | | | | | | | 0.05 |

TABLE-continued

| | 1 | 2 | 3 | 4 | 5 | 6 | 7 | 8 | 9 | 10 | 11 | 12 | 13 | 14 | 15 | Prior art I | Prior art II |
|---|---|---|---|---|---|---|---|---|---|---|---|---|---|---|---|---|---|
| phosphorus content[10] of b) and c) based on the total composition composing the components a), b) and c) [ppm] | 0 | 455 | 319 | 437 | 289 | 232 | 371 | 376 | 373 | 349 | 349 | 369 | 369 | 354 | 163 | 537 | 537 |
| Four ball tester (DIN 51 530, IP 239) Wear scar diameter 60 min, 400 N, 40° C., 1400 revs/min [mm] | 0.62 | 0.9 | 0.9 | 0.43 | 0.59 | 0.43 | — | 0.42 | — | 0.42 | 0.40 | 0.41 | — | 0.38 | 0.44 | 0.41 | — |
| friction wear - ball/plate system (300 N, 2 h, 100° C., 50 Hz) indentation wear plate max. profile depth [μm] | 8.0 | 12.0 | — | 7.0 | — | 8.7 | 0.9 | 1.4 | — | 0.9 | — | 0.7 | — | 0.8 | 0.9 | 0.5 | — |
| Specific water-compatibility test oil + 1% dist $H_2O$ stored at 100° C./10 days, followed by: | | | | | | | | | | | | | | | | | Sol'n. turbid at RT |
| AFNOR-pressure-filtration through 0.8 μm filter FI | 1.1 | 1.2 | — | 1.3 | — | 1.4 | 1.5 | 1.6 | 1.3 | 1.2 | 1.1 | 1.1 | 1.2 | 1.1 | 1.2 | 1.35 | 1.3[11] |
| steel corrosion test ASTM D 665 B | 0 | 0 | — | 0 | — | 1 | 2 | 2 | 1 | 0.5 | 0 | 0 | 0 | 0 | 0 | 3 | 2 |
| FZG/FLS (DIN 51 354, 17/8.3/90) | 7 | — | | 7 | — | 8 | 8 | 8 | — | 8 | — | 12 | — | 12 | 11 | 10 | — |

[1]component $b)_1$: Irgalube* TPPT (triphenyl thionophosphate)
[2]component $b)_2$: liquid mixture of tri[(alkyl)aryl]thionophosphates as described in EP 368 803
[3]component $c)_1$: Irgalube* 63 {3-[(bis-isopropyloxyphosphinothioyl)thio]propionic acid ethyl ester}
[4]component $c)_2$: bis(O,O-dialkyldithiophosphate)
[5]component $d)_1$: epoxidised isooctyl stearate (e.g.: Edenol* B33 from Henkel)
[6]component $d)_2$: glycerol monooleate (e.g.: Kessco* GMO from Akzo)
[7]component $d)_3$: oleylamine (e.g.: Armeen* O, OD from Akzo)
[8]component e): Irgalube* 349 (aminephosphate)
[9]diethylenetetraammonium dinonylnaphthylsulfonate (NA-SUL* DTA from KING)
[10]calculated on the basis of the empirical formula
[11]coarse precipitate on filter paper

What is claimed is:

1. A lubricant composition comprising a) a base oil of lubricating viscosity used for greases, for metal-working fluids, for gear fluids or for hydraulic fluids;

b) at least one thiophosphoric acid ester of formula I (I)

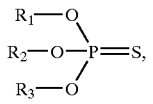

wherein $R_1$, $R_2$ and $R_3$ are substitutents selected from the group consisting of $C_3$–$C_{20}$alkyl, $C_5$–$C_{12}$cycloalkyl, $C_7$–$C_{12}$bicycloalkyl, phenyl, $C_7$–$C_{18}$alkylphenyl, $C_7$–$C_{18}$alkoxyphenyl, naphthyl and $C_7$–$C_9$phenylalkyl c) at least one compound of formula II (II)

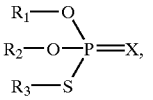

wherein X is oxygen or sulfur, and $R_1$ and $R_2$ are unsubstituted $C_3$–$C_{10}$hydrocarbon radicals and $R_3$ is $C_2$–$C_4$-alkyl which is substituted by a group of the sub-formula (A)

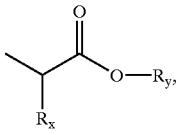

wherein $R_x$ and $R_y$ are hydrogen or $C_1$–$C_4$alkyl; and d) at least one oil additive selected from the group consisting of polyol partial esters, primary $C_1$–$C_{20}$alkylamines, secondary $C_1$–$C_{20}$alkylamines, alkanolamines, etheramines, polyoxyalkylene diamines, polyoxyalkylene polyamines, primary amines having $C_5$–$C_6$cycloalkyl radicals, secondary amines having $C_5$–$C_6$cycloalkyl radicals and epoxides with the proviso that the composition is metal free.

2. A composition according to claim 1 wherein the phosphorus content of the thiophosphoric acid ester component b) combined with the compound of formula II component c), based on the composition comprising components a), b) and c), is less than 400 ppm.

3. A composition according to claim 1 comprising b) a mixture of thiophosphoric acid esters of formula:

(I')

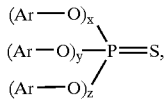

wherein x is from 0 to 2.7, y is 3-(x+z), z is from 0 to 3-(x+y) and x+y+z=3, and Ar is phenyl, $C_7$–$C_{18}$alkylphenyl, $C_7$–$C_{18}$alkoxyphenyl, naphthyl or $C_7$–$C_9$phenylalkyl.

4. A composition according to claim 1 comprising c) at least one dithiophosphoric acid ester of formula II wherein X is sulfur, $R_1$ and $R_2$ are $C_3$–$C_{10}$alkyl and $R_3$ is $C_2$–$C_4$-alkyl which substituted by a group of the sub-formula (A), wherein $R_x$ and $R_y$ are hydrogen or $C_1$–$C_4$alkyl.

5. A composition according to claim 1 comprising c) at least one dithiophosphoric acid ester of formula II where X is sulfur, $R_1$ and $R_2$ are $C_3$–$C_{10}$alkyl and $R_3$ is 2-carboxyeth-1-yl or 2-$C_1$–$C_4$alkoxycarbonyleth-1-yl.

6. A composition according to claim 1 comprising a) a base oil of lubricating viscosity used for greases, for metal-working fluids, or gear fluids or for hydraulic fluids;

b) mixtures of thiophosphoric acid esters of formula I'

(I')

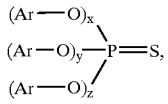

wherein x is from 0 to2.7, y is 3-(x+z), z is from 1 to 3-(x+y) and x+y+z=3, and Ar is phenyl or $C_7$–$C_{18}$alkylphenyl;

c) at least one dithiophosphoric acid ester of formula II wherein X is sulfur, $R_1$ and $R_2$ are $C_3$–$C_{10}$alkyl and $R_3$ is 2-carboxyeth-1-yl or 2–$C_1$–$C_4$alkoxycarbonyleth-1-yl, d) at least one oil additive selected from the group consisting of polyol partial esters, primary $C_1$–$C_{20}$alkylamines, secondary $C_1$–$C_{20}$alkylamines, alkanolamines, etheramines, polyoxyalkylene diamines, polyoxyalkylene polyamines, primary amines having $C_5$–$C_6$cycloalkyl radicals, secondary amines having $C_5$–$C_6$cycloalkyl radicals and epoxides, wherein the phosphorus content of the thiophosphoric acid ester component b) combined with the dithiophosphoric acid ester or phosphoric acid thioester component c), based on the composition comprising components a), b) and c), is less than 400 ppm.

7. A lubricant composition according to claim 1 comprising:

a) a base oil of lubricating viscosity used for greases, for metal-working fluids, for gear fluids or for hydraulic fluids;

b) at least one thiophosphoric acid ester of formula (I):

(I)

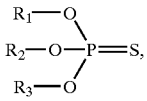

wherein $R_1$, $R_2$ and $R_3$ are substitutents selected from the group consisting of $C_3$–$C_{20}$alkyl, $C_5$–$C_{12}$cycloalkyl, $C_7$–$C_{12}$bicycloalkyl, phenyl, $C_7$–$C_{18}$alkylphenyl, $C_7$–$C_{18}$alkoxyphenyl, naphthyl and $C_7$–$C_9$phenylalkyl c) at least one compound of formula (II):

(II)

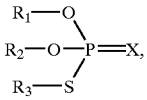

wherein X is oxygen or sulfur and $R_1$ and $R_2$ are unsubstituted $C_3$–$C_{10}$hydrocarbon radicals and $R_3$ is $C_2$–$C_4$alkyl which is substituted by a group of the sub-formula (A)

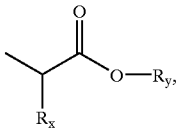

wherein $R_x$ and $R_y$ are hydrogen or $C_1$–$C_4$alkyl; and d) a polyol partial ester.

8. A lubricant composition comprising a) a base oil of lubricating viscosity used for greases, for metal-working fluids, for gear fluids or for hydraulic fluids;

b) at least one thiophosphoric acid ester of formula I (I)

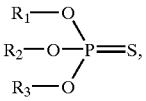

wherein $R_1$, $R_2$ and $R_3$ are substitutents selected from the group consisting of $C_3$–$C_{20}$alkyl, $C_5$–$C_{12}$cycloalkyl, $C_7$–$C_{12}$bicycloalkyl, phenyl, $C_7$–$C_{18}$alkylphenyl, $C_7$–$C_{18}$alkoxyphenyl, naphthyl and $C_7$–$C_9$phenylalkyl;

c) at least one dithiophosphoric acid ester of formula II (II)

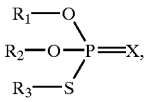

wherein X is sulfur, and $R_1$ and $R_2$ are unsubstituted $C_3$–$C_{10}$hydrocarbon radicals and $R_3$ is $C_2$–$C_4$-alkyl which is substituted by a group of the sub-formula (A)

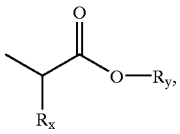

wherein $R_x$ and $R_y$ are hydrogen or $C_1$–$C_4$alkyl; and d) at least one oil additive selected from the group consisting of polyol partial esters, primary $C_1$–$C_{20}$alkylamines, secondary $C_1$–$C_{20}$alkylamines, alkanolamines, etheramines, polyoxyalkylene diamines, polyoxyalkylene polyamines, primary amines having $C_5$–$C_6$cycloalkyl radicals, secondary amines having $C_5$–$C_6$cycloalkyl radicals and epoxides;

e) an ammonium phosphate ester of formula III (III)

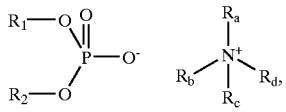

wherein $R_1$ and $R_2$ are $C_1$–$C_{20}$hydrocarbon radicals, and $R_a$, $R_b$, $R_c$ and $R_d$ is each independently of the others hydrogen or a $C_1$–$C_{20}$hydrocarbon radical; and f) at least one customary oil additive selected from the group consisting of antioxidants, metal passivators, rust inhibitors, viscosity index enhancers, pour-point depressants, dispersants, detergents, extreme-pressure additives and anti-wear additives with the proviso that the composition is metal free.

9. A composition according to claim 8 comprising components a) to f) as defined therein, wherein the phosphorus content of components b), c) and e), based on the total composition, is less than 400 ppm.

10. A composition according to claim 8 comprising components a) to f) as defined therein, wherein the phosphorus content of components b) and c), based on the composition comprising components a), b) and c), is from 150 to 390 ppm.

11. A composition according to claim 8 comprising components a) to f) as defined therein, wherein the phosphorus content of components b) and c), based on the composition comprising components a), b) and c), is from 160 to 370 ppm.

12. A composition according to claim 8 comprising e) at least one ammonium phosphate ester of formula III wherein $R_1$ and $R_2$ are $C_1$–$C_{20}$alkyl, one of the radicals $R_a$, $R_b$, $R_c$ and $R_d$ is hydrogen and the other radicals are $C_1$–$C_{20}$alkyl.

13. A composition according to claim 8 comprising a) a base oil of lubricating viscosity used for greases, for metal-working fluids, for gear fluids or for hydraulic fluids;

b) at least one thiophosphoric acid ester of formula I wherein $R_1$, $R_2$ and $R_3$ are phenyl, or mixtures of thiophosphoric esters of formula I' wherein x is 0 to 2.7, y is 3–(x+z), z is from 0 to 3–(x+y) and x+y+z=3, Ar is phenyl or $C_7$–$C_{18}$alkylphenyl;

c) at least one dithiophosphoric acid ester of formula II wherein X is sulfur, $R_1$ and $R_2$ are $C_3$–$C_{10}$alkyl and $R_3$ is 2-carboxyeth-1-yl or 2-$C_1$–$C_4$alkoxycarbonyleth-1-yl;

d) at least one additive selected from the group consisting of polyol partial esters, primary $C_1$–$C_{20}$alkylamines, secondary $C_1$–$C_{20}$alkylamines, alkanolamines, etheramines, polyoxyalkylene diamines, polyoxyalkylene polyamines, primary amines having $C_5$–$C_6$cycloalkyl radicals, secondary amines having $C_5$–$C_6$cycloalkyl radicals and epoxides;

e) at least one ammonium phosphate ester of formula III wherein $R_1$ and $R_2$ are $C_1$–$C_{20}$alkyl, one of the radicals $R_a$, $R_b$, $R_c$ and $R_d$ is hydrogen and the other radicals are $C_1$–$C_{20}$alkyl;

f) at lease one customary oil additive selected from the group consisting of antioxidants, metal passivators, rust inhibitors, viscosity index enhancers, pour-point depressants, dispersants, detergents, extreme-pressure additives and anti-wear additives;

wherein the phosphorus content of components b), c) and e), based on the total composition, is less than 400 ppm.

14. A concentrate comprising b) at least one thiophosphoric acid ester of formula I:

(I)

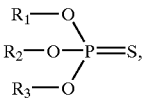

wherein $R_1$, $R_2$ and $R_3$ are substitutents selected from the group consisting of $C_5$–$C_{20}$alkyl, $C_5$–$C_{12}$cycloalkyl, $C_7$–$C_{12}$bicycloalkyl, phenyl, $C_7$–$C_{18}$alkylphenyl, $C_7$–$C_{18}$alkoxyphenyl, naphthyl and $C_7$–$C_9$phenylalkyl;

c) at least one compound of formula II:

(II)

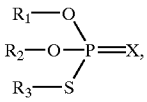

wherein X is oxygen or sulfur and $R_1$, $R_2$ and $R_3$ are unsubstituted or substituted $C_3$–$C_{20}$hydrocarbon radicals; and d) at least one oil additive selected from the group consisting of polyol partial esters, amines and epoxides with the proviso that the composition is metal free.

* * * * *